US006978983B1

(12) United States Patent
Sclease et al.

(10) Patent No.: US 6,978,983 B1
(45) Date of Patent: Dec. 27, 2005

(54) ROD PULLER APPARATUS AND METHOD

(76) Inventors: Joseph L. Sclease, 3472 Maikai Dr., Pensacola, FL (US) 32526; Scottie E. Harris, 5261 Westwind Cir., Pensacola, FL (US) 32526

( * ) Notice: Subject to any disclaimer, the term of this patent is extended or adjusted under 35 U.S.C. 154(b) by 0 days.

(21) Appl. No.: 10/422,371

(22) Filed: Apr. 24, 2003

Related U.S. Application Data

(60) Provisional application No. 60/375,541, filed on Apr. 25, 2002.

(51) Int. Cl.[7] ..... B25B 1/04
(52) U.S. Cl. ..... 254/30
(58) Field of Search ..... 254/29 R, 30, 254/31, 132

(56) References Cited

U.S. PATENT DOCUMENTS 2,926,890 A * 3/1960 Majors ..... 254/132
3,779,516 A * 12/1973 King ..... 254/30
3,991,976 A * 11/1976 Skinner ..... 254/30

* cited by examiner

*Primary Examiner*—Robert C. Watson
(74) *Attorney, Agent, or Firm*—J. Nevin Shaffer, Jr.

(57) ABSTRACT

A rod puller apparatus and method includes an extended lever. A roller pad is connected to the extended lever. A releasable grab attachment is connected to the roller pad. In a preferred embodiment, a foot leverage platform is connected to the roller pad. In a further preferred embodiment, a replaceable guide roller is provided so as to accommodate rods of various diameters. Other grab attachments are provided for rods with mushroomed heads and for square posts and/or metal fence posts.

16 Claims, 8 Drawing Sheets

ROD PULLER APPARATUS AND METHOD

CROSS REFERENCE TO RELATED APPLICATION

The applicants hereby claim the benefit of the earlier filing date of Apr. 25, 2002, of Provisional Application Ser. No. 60/375,541, under 35 U.S.C.§ 119 (e).

TECHNICAL FIELD OF THE INVENTION

This invention relates to a rod puller apparatus and method. In particular, the invention relates to a rod puller apparatus and method for removing rods, posts and the like from the ground without bending or breaking the rods or posts.

BACKGROUND OF THE INVENTION

Many situations exist wherein rods, posts, pilings and the like are driven into the ground to serve a temporary purpose. By way of example only, and not limitation, in the construction industry it is necessary for steel rods, many feet in length, to be sunk into the ground at the construction site. The rods can serve any purpose, but, for example again, often are used as electrical grounding devices. Certainly, many other needs are served by such temporary rods, such as for surveying purposes, locating cement car stops in parking lots, metal, wood, and cement fence and sign posts and the like.

In any event, once installed, it is often necessary to remove these "rods". This has proven to be a difficult, time-consuming, and destructive process. That is, for example only, heretofore, the removal of long, metal, rods which have been driven deep into the earth, often results in the rods being bent beyond reusable form. One prior art method is to tie a chain to the rod and use a back hoe, or the like, to yank the rod out of the ground. Even if this is successful, the rod is generally so bent and deformed as to be of no possible further use.

In some cases, the rod has been driven into ground so hard and to such a depth that removal is, for all practical purposes, impossible. In this case, the prior art solution is to cut the rod off as close to the ground level as possible and then drive the stub below grade and leave the rest of the rod forever buried at the construction site.

By way of further example, these metal rods are generally made of steel, are eight to ten feet long, and vary in diameter from one-half to three-quarter inches. Additionally, utility companies, construction firms, and the like, invest a large amount of money in maintaining a supply of such rods. Companies use other rods as well such as four foot long curb pins and two to four foot long grading stakes. Any rods, whether metal, wood, cement, or the like, that can be reclaimed and reused helps reduce the costs to such companies.

Thus, there is a need in the art for providing an apparatus and method for pulling sunken rods or posts that leaves the rods and posts intact and reusable.

SUMMARY OF THE INVENTION

Accordingly, the rod puller apparatus and method of the present invention includes an extended lever. A roller pad is connected to the extended lever. A releasable grab attachment is movably connected to the roller pad. In a preferred embodiment, the releasable grab attachment is removable and adjustable for various sized rods. In another preferred embodiment, the roller pad includes a foot leverage platform. In another preferred embodiment, the roller pad includes an attachment for a replacement guide roller.

In yet another preferred embodiment, a method of pulling rods includes the step of providing an extended lever. A roller pad is attached to one end of the extended lever. A releasable grab attachment is connected to the roller pad. A portable support is placed next to a rod which has previously been driven into the ground. The roller pad is placed on the portable support. The extended lever is moved toward the rod and the releasable grab attachment is placed over the rod. The lever arm is moved away from the rod resulting in the rod being pulled a small distance out of the ground. The steps are repeated until the rod is completely removed from the ground.

In another aspect of this embodiment, the releasable grab attachment includes a replacement guide roller conformed to fit rods with different diameters. In another aspect of this embodiment, a foot leverage platform is provided on the roller pad and a user's foot is used to assist in the movement of the roller pad by means of the extended lever formed by the foot leverage platform.

BRIEF DESCRIPTION OF THE DRAWINGS

Other objects, features, and advantages of the present invention will become more fully apparent from the following detailed description of the preferred embodiment and the accompanying drawings in which.

DESCRIPTION OF THE PREFERRED EMBODIMENTS

Figure 3:
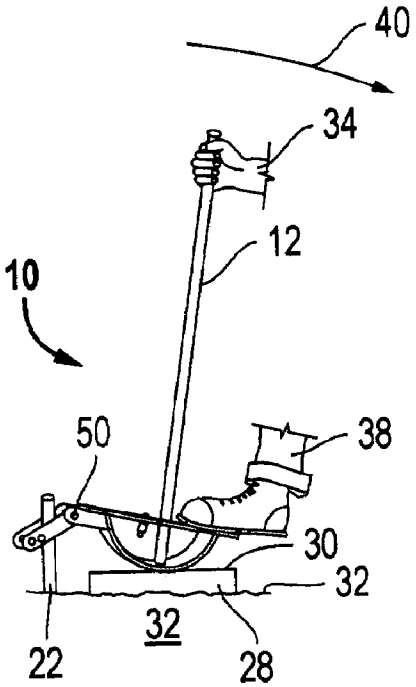
FIG. 3 is a side view illustration of the apparatus of FIG. 1 at the end of the first pull cycle.

The preferred embodiments of the present invention are illustrated by way of example FIGS. 1–15. With specific reference to FIG. 1, the rod puller apparatus 10 of the present invention includes extended lever 12. Roller pad 14 is connected to one end 16 of extended lever 12. A releasable grab attachment 18 is connected to the front 20 of roller pad 14.

Figure 1:
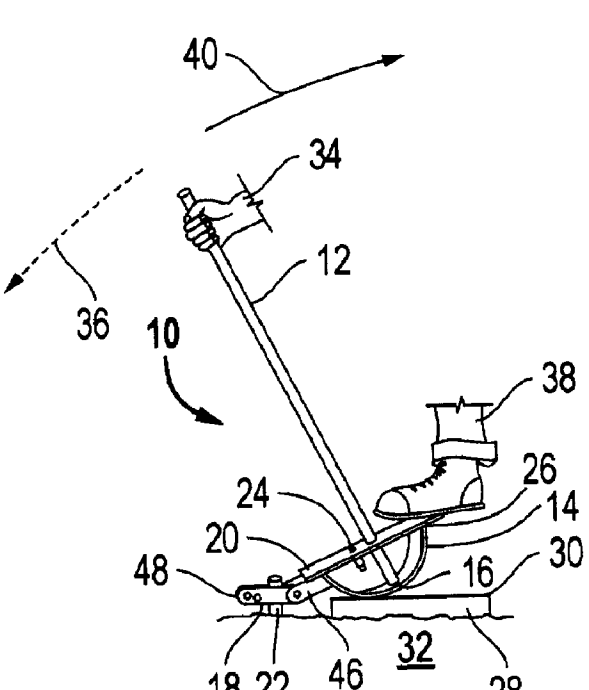
FIG. 1 is a side view illustration of the rod puller apparatus according to one embodiment at the start of the first pull cycle.

In a preferred embodiment, releasable grab attachment 18 moves slightly so as to allow parallel alignment of the grab attachment 18 with, and in relation to, rod 22. In a preferred embodiment, a replaceable guide roller 24 is connected to the front of roller pad 14 as more fully disclosed and described hereafter. In another preferred embodiment, roller pad 14 includes foot leverage platform 26. FIG. 1 also illustrates the use of portable support 28 located close to rod 22 and utilized to provide a supporting surface 30 for roller pad 14 above ground 32.

Figure 2:
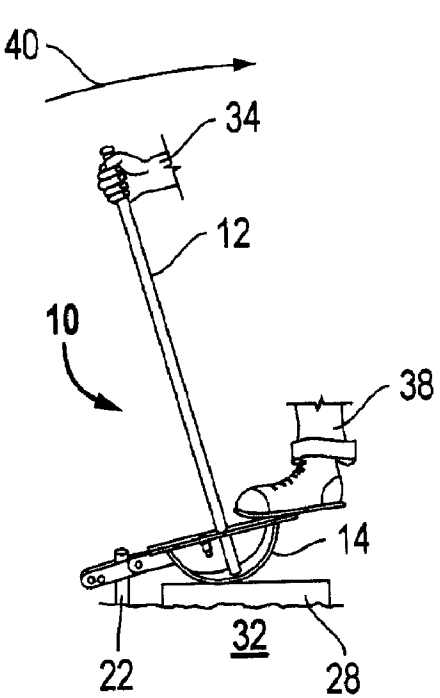
FIG. 2 is a side view illustration of the apparatus of FIG. 1 near the middle of the first pull cycle.
Figure 4:
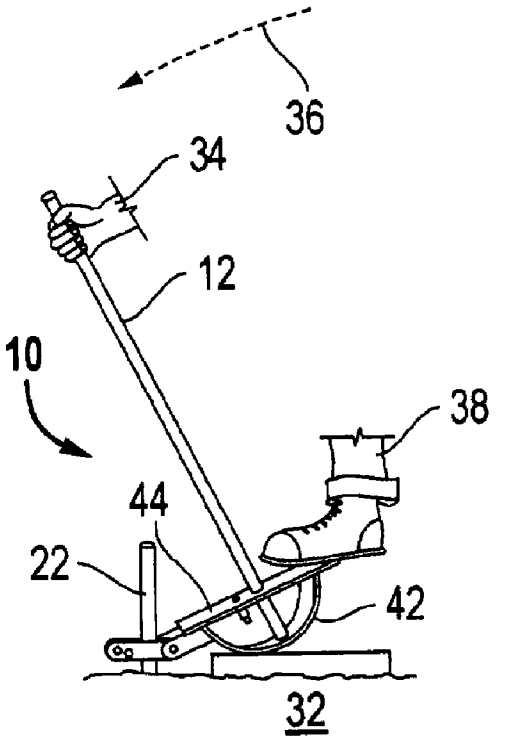
FIG. 4 is a side view illustration of the apparatus of FIG. 1 at the start of the second pull cycle.
Figure 5:
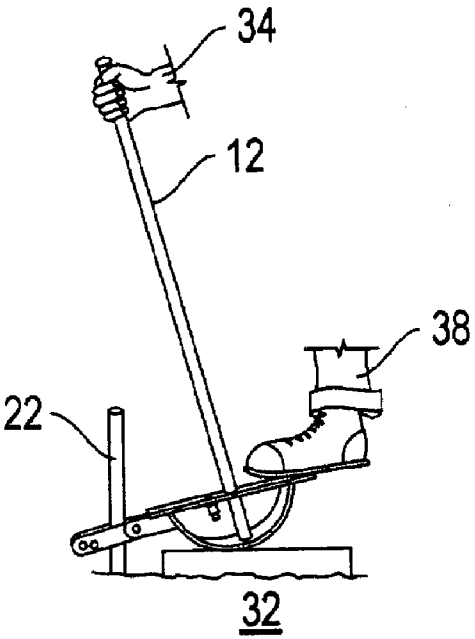
FIG. 5 is a side view illustration of the apparatus of FIG. 1 near the middle of the second pull cycle.
Figure 6:
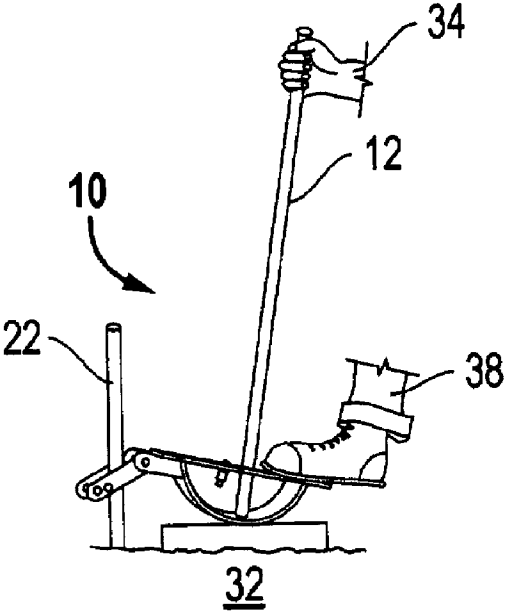
FIG. 6 is a side view illustration of the apparatus of FIG. 1 at the end of the second pull cycle.

In operation, portable support 28 is placed on the ground 32 in close proximity to rod 22. Extended lever 12 is grasped by a user's hand 34 and roller pad 14 is placed on supporting surface 30 and rotated in the direction of dotted arrow 36 which is in the direction of rod 22. At that point, releasable grab attachment 18 fits snugly over rod 22. The user then places his/her foot 38 on foot leverage platform 26 and pulls extended lever 12 with his/her hand 34 away from rod 22 in the direction of solid arrow 40 as shown in FIG. 2 and pushing down on foot leverage platform 26 with his/her foot 28. This pinches rod 22 between grab attachment 18 and the front 20 of roller pad 14 or, in a preferred embodiment, replaceable guide roller 24. When roller pad 14 reaches the limit of its travel in the direction of solid arrow 40 as shown in FIG. 3, the process is repeated again as illustrated in FIGS. 4, 5, and 6 until the rod 22 is pulled completely from the ground 32.

Rod puller apparatus 10 accomplishes the extraction of rod 22 from ground 32 by a series of cycles. The "first" cycle is illustrated by way of example in FIGS. 1–3. The "second" cycle is illustrated by way of example in FIGS. 4–6. Importantly, however many cycles are required to fully extract rod 22 from the ground, rod 22 is extracted essentially without damage, bending, or deformation of any kind.

By way of further explanation, with reference to FIGS. 1–6, roller pad 14 is comprised of a curved, "curvate", lower section 42 and a top section 44. As illustrated, extended lever 12, in a preferred embodiment, extends through top section 44 such that end 16 of extended lever 12 is connected to curved lower section 42 of roller pad 14. Certainly, any appropriate confirmation for the connection of extended lever 12 with roller pad 14 is suitable for purposes of the invention.

Again, by way of additional explanation, releasable grab attachment 18 is connected to the front 20 of roller pad 14. Releasable grab attachment 18, in a preferred embodiment consists of stationery extension 46 and rotatable section 48. Rotatable section 48 is rotatably connected to stationery extension 46 by any means known in the art such as pin 50. As clearly shown in FIGS. 1 and 4, this configuration enables releasable grab attachment 18 to connect with rod 22 in a manner approximately perpendicular to rod 22. Additionally, as illustrated in FIGS. 2, 3, 5, and 6, the ability of rotatable section 48 to rotate ensures, in combination with the short cycles of the invention, that rod 22 is not bent or deformed as it is being pulled from ground 32.

Figure 7:
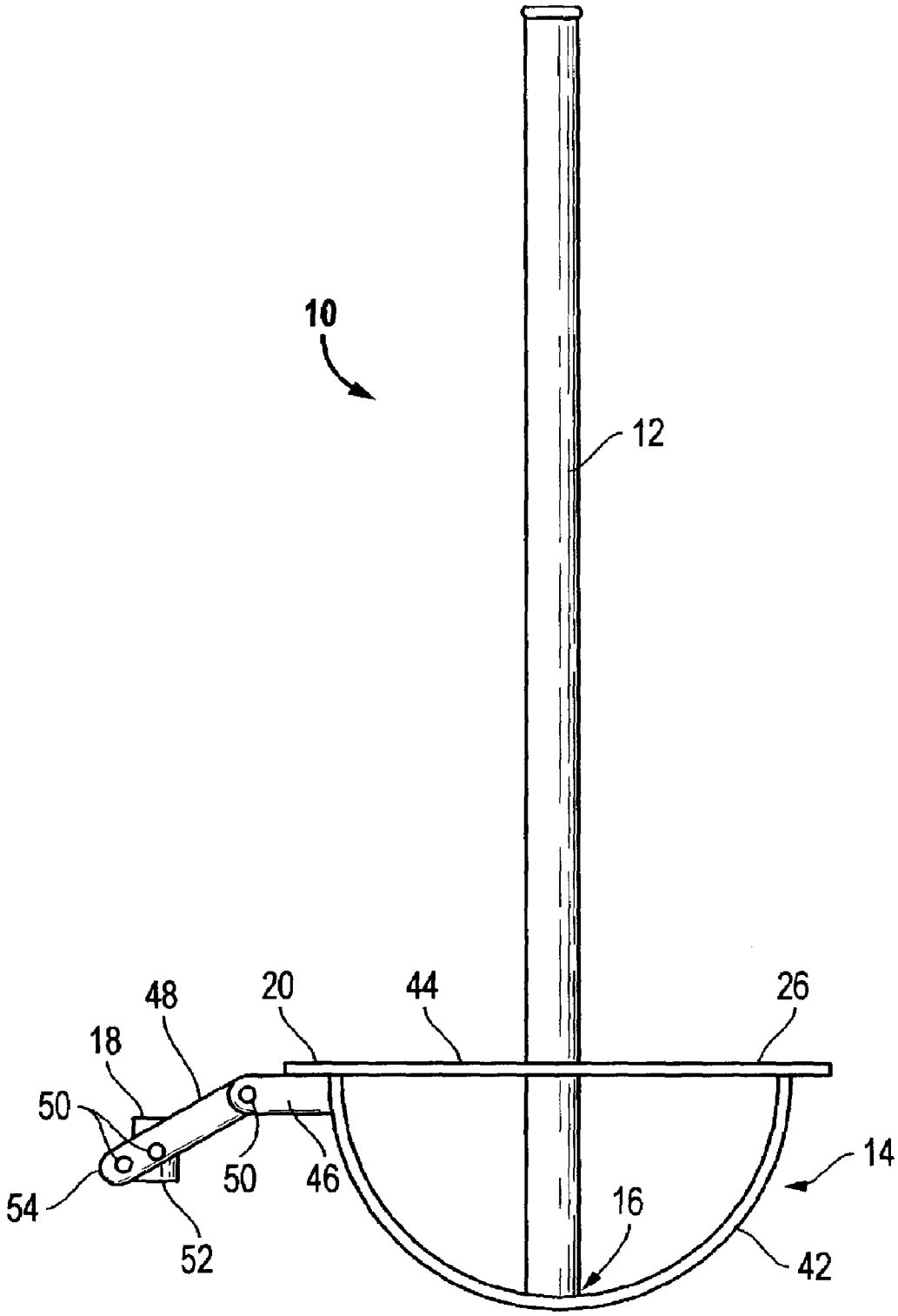
FIG. 7 is a side view illustration of the detail of the apparatus of FIG. 1.

FIG. 7 is a further illustration of the basic elements of the invention including the releasable grab attachment 18 of the present invention. Grab attachment 18 includes teeth 52 for a better purchase on rod 22. Grab attachment is moveably connected to rotatable section 48 by a pin 50 and is prevented from full rotation by another pin 50 at the end 54 of rotatable section 48.

Figure 8:
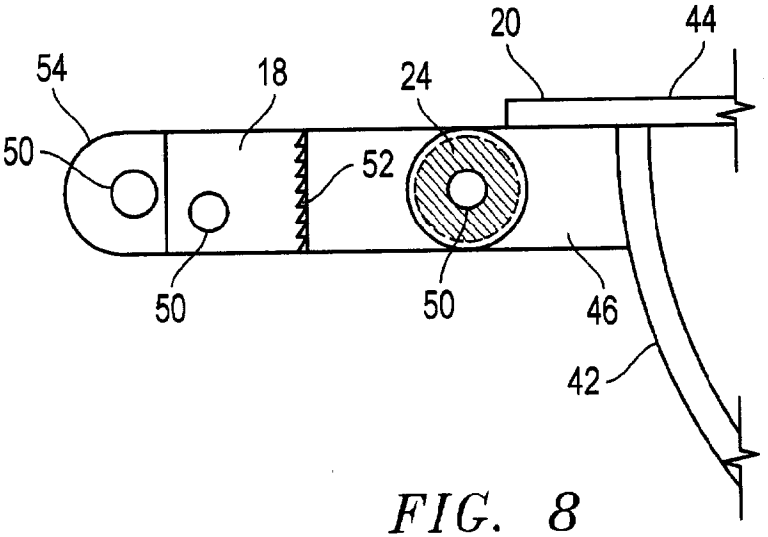
FIG. 8 is an enlarged side view illustration of the detail of the releasable grab attachment and replaceable guide roller according to one embodiment of the apparatus of FIG. 1.
Figure 9:
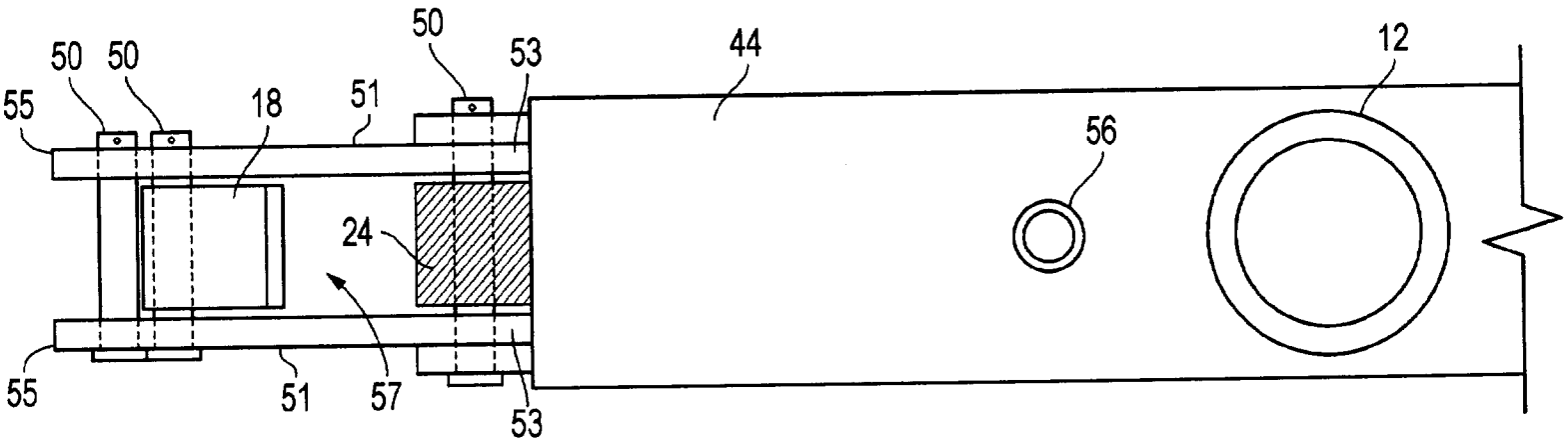
FIG. 9 is a top view of the apparatus of FIGS. 1 and 8.

Referring now to FIGS. 8 and 9, the replaceable guide roller 24 of the present invention is illustrated. In FIG. 8, no rotatable extension 48 is used and only stationary extension 46 is provided. Even if rotatable extension is used the function is the same. That is, for purposes of example only and not by limitation, as shown in FIG. 9, a pair of support arms 51 with a first end 53 and a second end 55 are attached by pin 50 at the first end 53 to the front 20 of top section 44 of roller pad 14. The tubular shaped replaceable guide roller 24 is attached by pin 50 in between support arms 51 closer to front 20 of top section 44 than is grab attachment 18 such that a rod receiving space 57 is formed by the rectangular shaped grab attachment 18, guide roller 24 and support arms 51 for rod 22. In use, rod 22 is slipped in-between them into space 57 for pulling as described above. The applicants have found that a snug fit is preferable. As a result, different sizes of rods may be accommodated by removing and replacing the guide roller 24 with one with a smaller or larger diameter as required. FIG. 9 also shows support 56 in top section 44 for supporting a replacement guide roller 24 of a different diameter while another guide roller 24 is in use as more clearly illustrated in FIG. 10.

Figure 10:
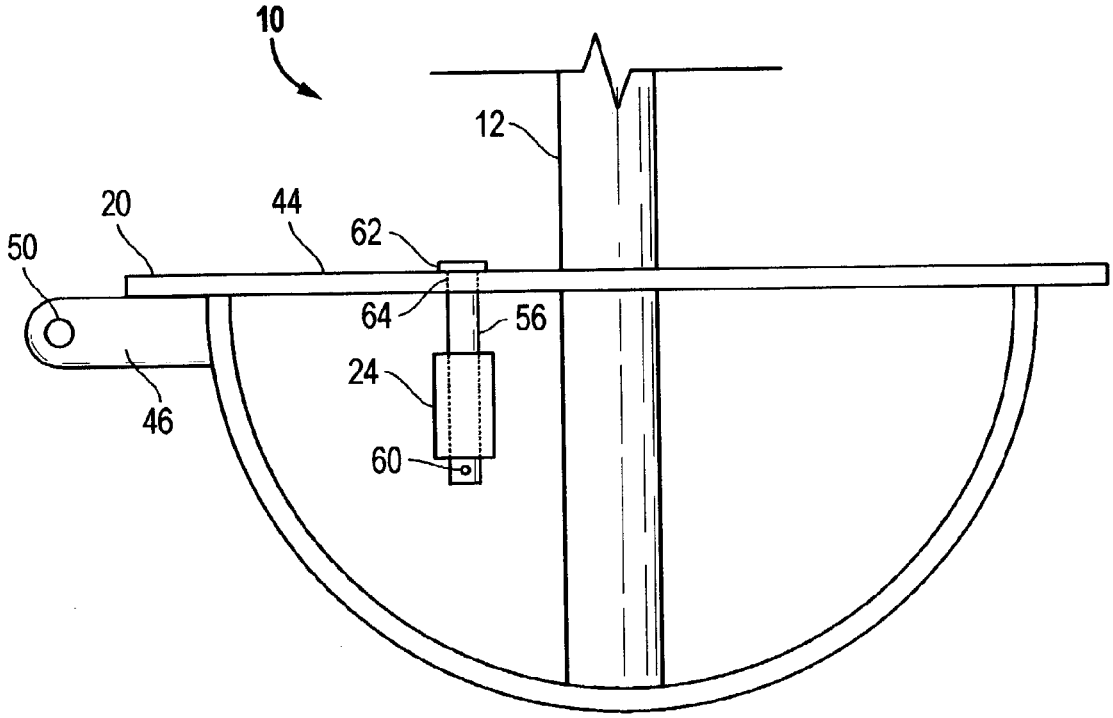
FIG. 10 is an enlarged side view of the apparatus of FIG. 1 illustrating the placement of the reserve replaceable guide roller.

FIG. 10 shows support 56 in the form of a pin of a diameter smaller than the inside diameter of guide roller 24 such that guide roller slips over support 56 and is retained in position on support 56 by use of a cotter pin 58 (see FIG. 11) in hole 60. Support 56 has a larger head 62 than the body of support 56 that prevent support 56 from slipping through the hole 64 in the top section 44. In this manner, extra roller guides are on hand, and out of harms way in operation, whenever a different size of rod is encountered.

Figure 11:
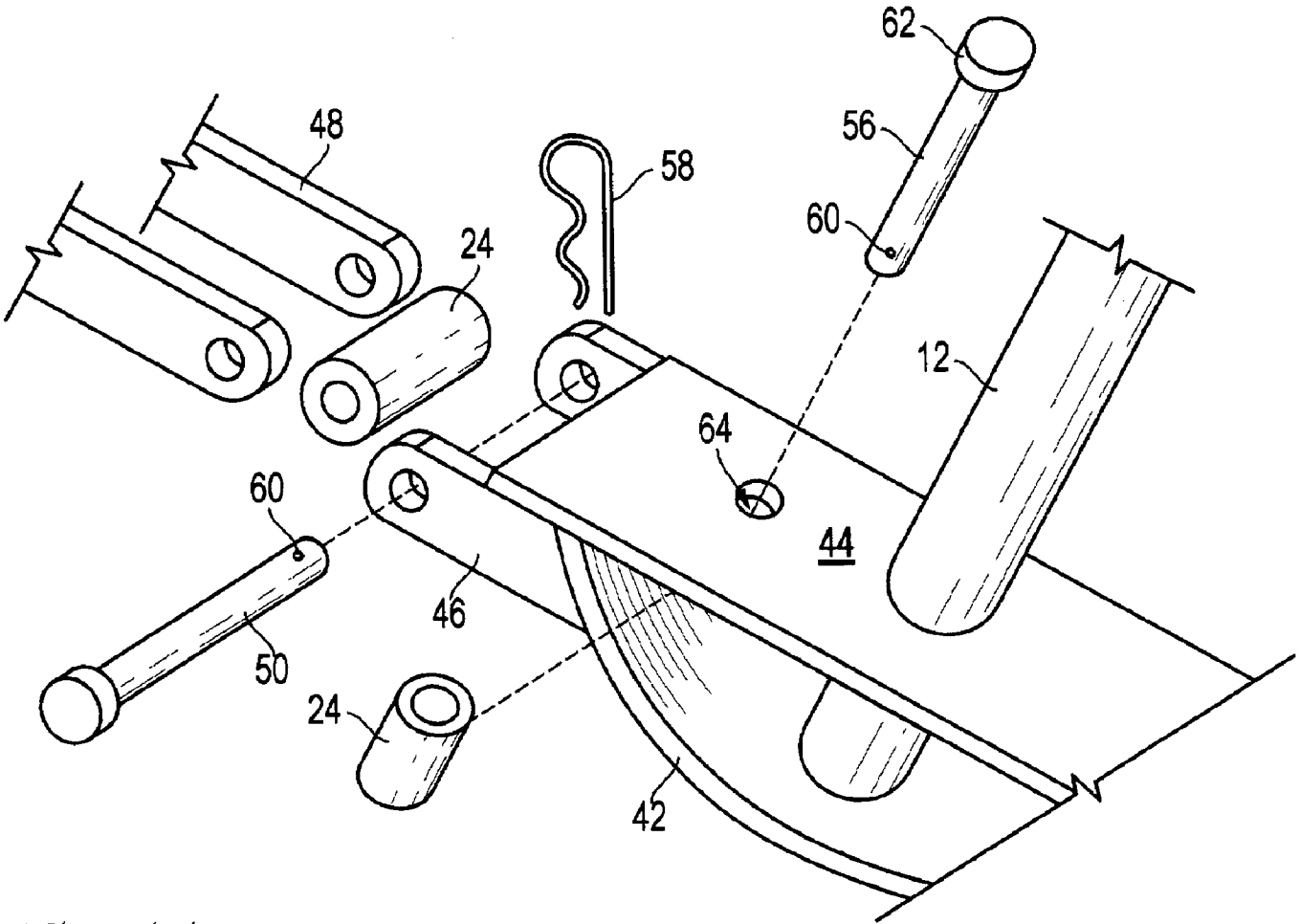
FIG. 11 is an exploded view of the apparatus of FIG. 1 showing the replaceable guide roller and a replacement guide roller.

FIG. 11 illustrates the connection of reserve guide roller 24 by means of support 56 and also the use of pin 50, also with large head 62, and cotter pin 58 to rotatably secure guide roller 24 to stationary extension 46 and rotatable extension 48. This same pin 50 and cotter pin 58 combination is used to secure grab attachment 18 (not shown) to rotatable extension 48.

Figure 12:
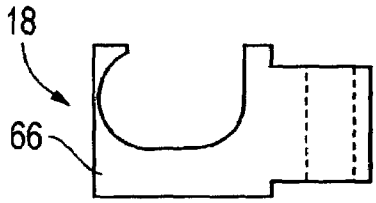
FIG. 12 is a bottom view of another embodiment of the releasable grab attachment of the apparatus of FIG. 1.
Figure 13:
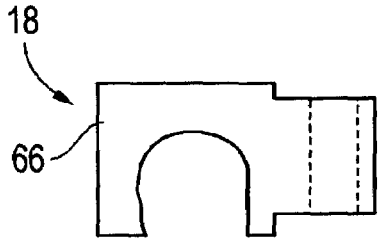
FIG. 13 is a top view of the grab attachment of FIG. 12.
Figure 14:
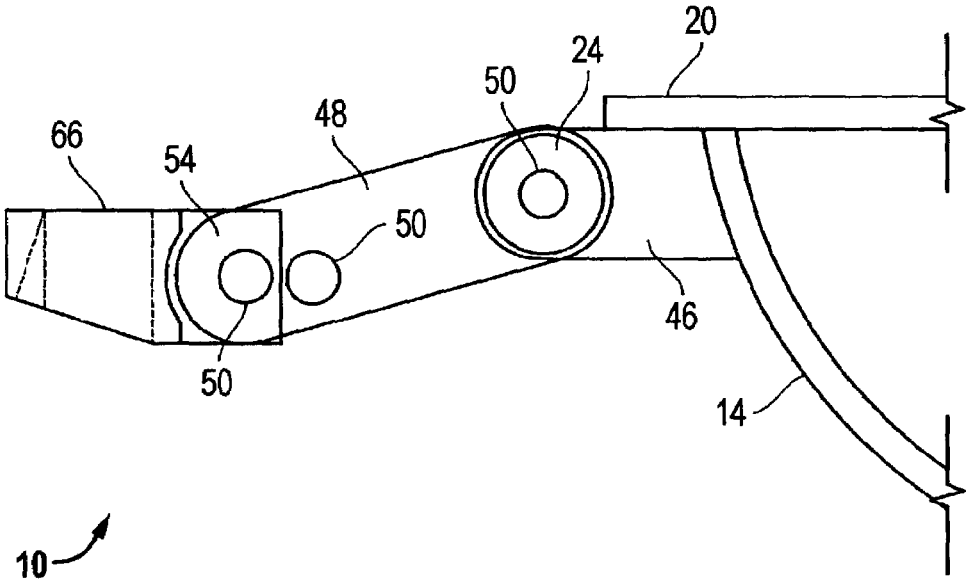
FIG. 14 is a side view of the apparatus with the grab attachment of FIGS. 12 and 13.

FIGS. 12 and 13 illustrate the bottom and top, respectively of another preferred embodiment of the grab attachment 18 of the present invention. In situations where the top of the item to be pulled is too large for the grab attachment 18 to slip over it, as described above, side loading jaw 66 is used. For example, when the head of a rod 22 is mushroomed out by repeated blows of a sledge hammer, side loading jaw 66 is attached to the front 20 of the invention for use as described above. FIG. 14 shows the attachment of side loading jaw 66 to rotatable extension 48 which is in turn connected to stationary extension 46 by pins 50 as discussed above. In this embodiment, however, side loading jaw 66 is attached to the pin 50 nearest the end 54 of rotatable extension 48.

Figure 15:
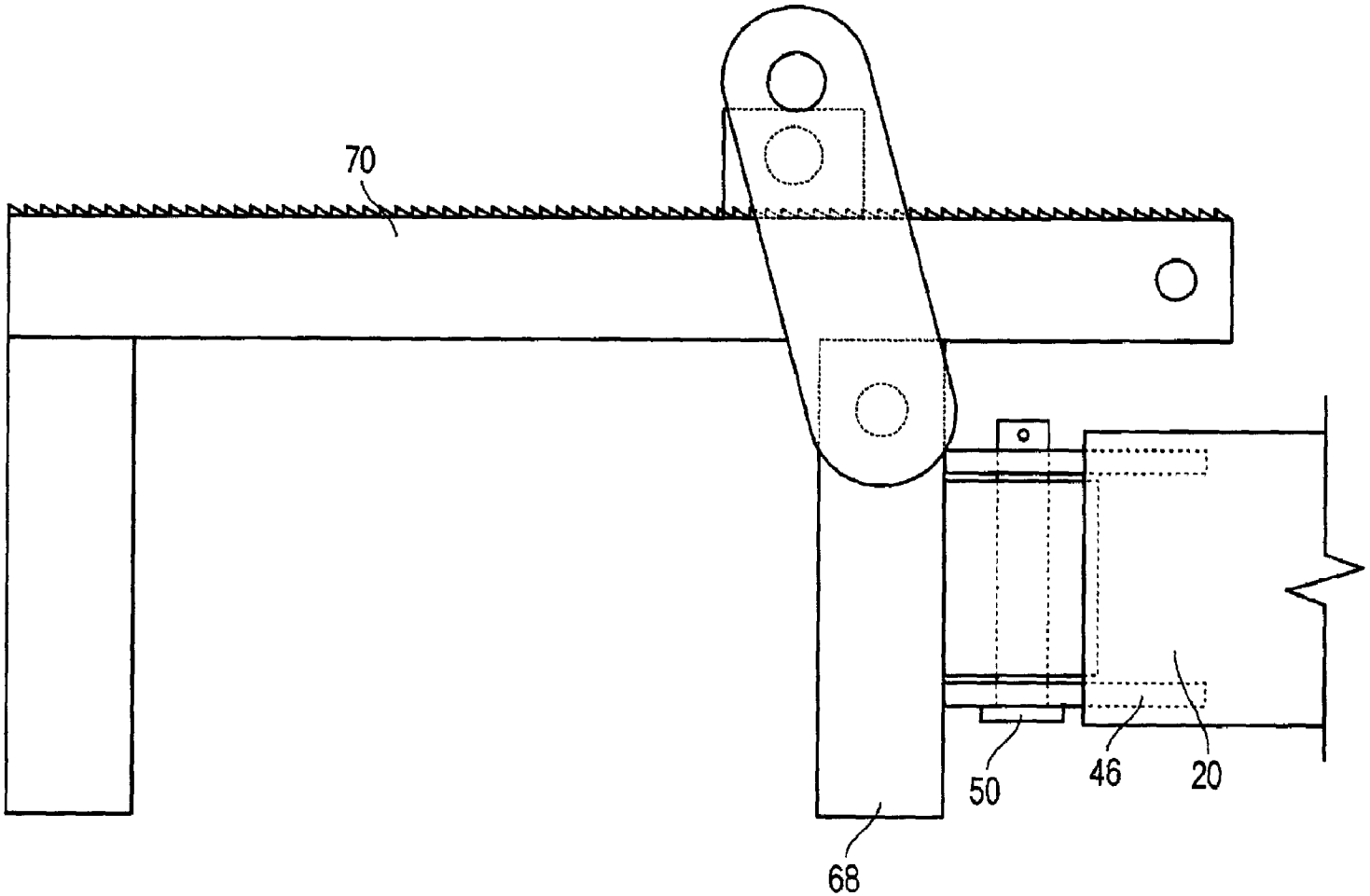
FIG. 15 is a top view of another embodiment of the releasable grab attachment of the apparatus of FIG. 1.

Referring now to FIG. 15, a grab attachment 18 that is conformed to pull posts and other non-round objects is disclosed. The grab attachment 18 in this embodiment includes a stationary arm 68 and slidable arm 70. Slidable arm 70 is moved toward stationary arm 68 so as to snug up against the post to be removed (not shown) on three of the four sides of the post. Thereafter the operation of the invention is as previously described. This grab attachment 18 is also useful in pulling metal fence posts.

The description of the present embodiments of the invention have been presented for purposes of illustration but are not intended to be exhaustive or to limit the invention to the form disclosed. Many modifications and variations will be apparent to those of ordinary skill in the art. As such, while the present invention has been disclosed in connection with the preferred embodiments thereof, it should be understood that there may be other embodiments which fall within the spirit and scope of the invention as disclosed herein and as defined by the following claims.

What is claimed is:

1. A rod puller apparatus comprising:

a) an elongated lever;

b) a curvate roller pad connected to said elongated lever; and c) a releasable grab attachment movably connected to the curvate roller pad such that the releasable grab attachment when in contact with a rod remains approximately parallel to the rod and wherein said releasable grab attachment further includes a guide roller.

2. The apparatus of claim 1 wherein element b) further includes a foot leverage platform attached to and extending from said curvate roller pad opposite from said releasable grab attachment.

3. The apparatus of claim 1 wherein said releasable grab attachment is removable and adjustable for rods of various sizes.

4. The apparatus of claim 1 further comprising a replacement guide roller.

5. The apparatus of claim 1 wherein element c) includes a releasable grab attachment with a plurality of teeth.

6. The apparatus of claim 1 wherein element c) includes a C-shaped releasable grab attachment.

7. The apparatus of claim 6 wherein said C-shaped releasable grab attachment is adjustable.

8. A rod pulling apparatus comprising;

a) a lever with a first and a second end;

b) a roller pad with a straight top section, with a front end and a back end, and a curved bottom section, with a pair of oppositely positioned ends, wherein the straight top section is attached to the oppositely positioned ends of the curved bottom section and wherein the second end of the lever is connected to the roller pad;

c) a releasable grab attachment movably attached to the front end of the straight top section of the roller pad such that the releasable grab attachment when in contact with a rod remains approximately parallel to the rod; and a foot leverage platform attached to and extending from the back end of the straight top section of the roller pad.

9. The apparatus of claim 8 further comprising:

a) a stationary extension connected to the front end of the straight top section; and b) a hinge connecting the releasable grab attachment to the stationary extension.

10. The apparatus of claim 8 further comprising a guide roller attached to the releasable grab attachment.

11. The apparatus of claim 10 further comprising a replacement guide roller of a different size than the guide roller.

12. The apparatus of claim 8 wherein the releasable grab attachment is C-shaped.

13. The apparatus of claim 12 wherein the C-shaped releasable grab attachment is adjustable.

14. The apparatus of claim 8 wherein the releasable grab attachment comprises:

a) a pair of support arms with first and second ends connected at the first ends by a pin to the front of the roller pad such that the pair of support arms are movable about the pin at the first ends; and b) a stop pin connected to the second ends;

c) wherein the pair of support arms are spaced apart by the removable grab attachment and a guide roller and wherein the removable grab attachment and the guide roller form a rod receiving space in between the pair of support arms.

15. The apparatus of claim 14 wherein the stop pin is conformed to limit the movement of the releasable grab attachment.

16. The apparatus of claim 14 wherein the releasable grab attachment is square with a plurality of grab teeth on one face and wherein the roller guide is tubular.

* * * * *